US010467941B2

(12) United States Patent
Hong et al.

(10) Patent No.: US 10,467,941 B2
(45) Date of Patent: Nov. 5, 2019

(54) DISPLAY DEVICE AND METHOD OF SUB-PIXEL TRANSITION

(71) Applicant: LG DISPLAY CO., LTD., Seoul (KR)

(72) Inventors: Jongwon Hong, Gyeongsangbuk-do (KR); SangHoon Kwon, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 132 days.

(21) Appl. No.: 15/685,421

(22) Filed: Aug. 24, 2017

(65) Prior Publication Data

US 2018/0090046 A1 Mar. 29, 2018

(30) Foreign Application Priority Data

Sep. 29, 2016 (KR) ..... 10-2016-0125354

(51) Int. Cl.
*G09G 3/3208* (2016.01)
*G09G 3/20* (2006.01)
*G09G 3/36* (2006.01)

(52) U.S. Cl.
CPC ..... *G09G 3/2003* (2013.01); *G09G 3/3614* (2013.01); *G09G 3/3208* (2013.01);
(Continued)

(58) Field of Classification Search
CPC ..... G09G 3/2003; G09G 3/3614; G09G 2320/0242; G09G 2360/08;
(Continued)

(56) References Cited

U.S. PATENT DOCUMENTS

2004/0125422 A1* 7/2004 Wang ..... G09G 3/3696 358/519
2004/0150599 A1 8/2004 Morita
(Continued)

FOREIGN PATENT DOCUMENTS

CN 102376281 A 3/2012
JP 2003-167556 A 6/2003
(Continued)

OTHER PUBLICATIONS

Communication pursuant to Article 94(3) EPC dated Dec. 20, 2018, issued in corresponding European Patent Application No. 17194155.2.
(Continued)

*Primary Examiner* — Jose R Soto Lopez
(74) *Attorney, Agent, or Firm* — Morgan, Lewis & Bockius LLP

(57) ABSTRACT

A display device includes a display panel including gate lines, data lines, a first color sub-pixel, a second color sub-pixel, and a third color sub-pixel, wherein the first color sub-pixel, the second color sub-pixel, and the third color sub-pixel are defined by intersections between the data lines and gate lines; a data driver configured to apply a source signal to the data lines; and a transition control unit configured to control a sequential supplying of the source signal to the first color sub-pixel, the second color sub-pixel, and the third color sub-pixel during a kth horizontal period and a sequential supplying of the source signal to the third color sub-pixel, the first color sub-pixel, and the second color sub-pixel during a k+1th horizontal period.

10 Claims, 11 Drawing Sheets

(52) U.S. Cl.
CPC ... *G09G 3/3607* (2013.01); *G09G 2300/0452* (2013.01); *G09G 2310/027* (2013.01); *G09G 2310/0297* (2013.01); *G09G 2310/08* (2013.01); *G09G 2320/0242* (2013.01); *G09G 2320/0247* (2013.01); *G09G 2320/0257* (2013.01); *G09G 2330/021* (2013.01); *G09G 2360/08* (2013.01)

(58) Field of Classification Search
CPC ... G09G 2320/0247; G09G 2310/0297; G09G 3/3208; G09G 2330/021; G09G 3/3607; G09G 2300/0452; G09G 2310/08; G09G 2310/027; G09G 2320/0257
See application file for complete search history.

(56) References Cited

U.S. PATENT DOCUMENTS

2005/0200582 A1* 9/2005 Goto ..... G09G 3/3648 345/89
2006/0001927 A1* 1/2006 Murade ..... G02F 1/1345 358/518
2006/0176256 A1* 8/2006 Yen ..... G09G 3/3688 345/88
2006/0250332 A1* 11/2006 Lo ..... G09G 3/20 345/76
2007/0176876 A1 8/2007 Lee
2007/0188523 A1* 8/2007 Lee ..... G09G 3/3614 345/690
2009/0002280 A1 1/2009 Kim et al.
2009/0002355 A1* 1/2009 Iwatsu ..... G09G 3/3688 345/205
2009/0085858 A1* 4/2009 Hsu ..... G09G 3/3688 345/100
2009/0129697 A1* 5/2009 Chang ..... G09G 3/003 382/274
2009/0231363 A1* 9/2009 Liu ..... G09G 3/3688 345/690
2009/0267932 A1* 10/2009 Lin ..... G09G 3/3614 345/212
2010/0013864 A1* 1/2010 Oelhafen ..... G09G 3/3688 345/690
2010/0033408 A1* 2/2010 Kawabe ..... G09G 3/2022 345/76
2010/0066720 A1 3/2010 Kawabe
2010/0182295 A1* 7/2010 Chen ..... G09G 3/3688 345/208
2010/0182333 A1* 7/2010 Chiang ..... G09G 3/36 345/589
2012/0299972 A1* 11/2012 Bae ..... G09G 3/3614 345/690
2012/0299983 A1* 11/2012 Chang ..... G09G 3/3614 345/691
2013/0076720 A1* 3/2013 Al-Dahle ..... G02F 1/136286 345/212
2013/0100111 A1* 4/2013 Shirai ..... G09G 3/2011 345/212
2013/0141320 A1 6/2013 Kim
2013/0148019 A1 6/2013 Wu et al.
2014/0111406 A1* 4/2014 Wang ..... G09G 3/3233 345/77
2014/0267218 A1* 9/2014 Pai ..... G09G 3/20 345/214
2014/0267473 A1* 9/2014 Washio ..... G09G 3/3688 345/694
2015/0090961 A1* 4/2015 Lee ..... H01L 22/30 257/40
2015/0248855 A1* 9/2015 Kim ..... G09G 3/2074 345/590
2016/0049129 A1* 2/2016 Hekstra ..... G09G 3/3688 345/174
2016/0078845 A1 3/2016 Lin et al.
2016/0093260 A1* 3/2016 Watsuda ..... G09G 3/3688 345/87
2016/0240160 A1 8/2016 Ito
2017/0017325 A1* 1/2017 Tsai ..... G06F 3/0412
2017/0061853 A1* 3/2017 Yang ..... G02F 1/1362
2017/0061872 A1* 3/2017 Zhou ..... G09G 3/3233
2017/0358261 A1* 12/2017 Zhou ..... G09G 3/3258
2018/0211633 A1* 7/2018 Peng ..... G09G 5/10
2019/0005900 A1* 1/2019 Chen ..... G09G 3/36

FOREIGN PATENT DOCUMENTS

JP 2004-045967 A 2/2004
JP 2007-010946 A 1/2007
JP 2008-122517 A 5/2008
TW 201324476 A 6/2013
TW 201324491 A 6/2013
TW 201443857 A 11/2014
TW 201602991 A 1/2016

OTHER PUBLICATIONS

Partial European Search Report dated Feb. 1, 2018, issued in corresponding European Patent Application No. 17194155.2.
Office Action dated Sep. 4, 2018, issued in corresponding Japanese Patent Application No. 2017-190528.
Extended European Search Report dated Apr. 20, 2018, issued in corresponding European Patent Application No. 17194155.2.
Office Action dated Mar. 13, 2018, issued in corresponding Taiwanese Patent Application No. 106131375.

* cited by examiner

DISPLAY DEVICE AND METHOD OF SUB-PIXEL TRANSITION

This application claims priority from Korean Patent Application No. 10-2016-0125354, filed on Sep. 29, 2016, which is hereby incorporated by reference for all purposes as if fully set forth herein.

BACKGROUND

Field of the Invention

The present invention relates to a display device, and more particularly, to a display device capable of reducing an effect caused by a transition between sub-pixels and a method of a sub-pixel transition using the same.

Description of the Related Art

With progress of the information-oriented society, various types of demands for display devices for displaying an image are increasing. Recently, various types of display devices, such as a liquid crystal display (LCD), a plasma display panel (PDP), and an organic light emitting diode (OLED) display device have been used.

A display panel in such a display device includes an active area AA that provides an image to a user and a non-active area NA that is a peripheral area of the active area AA. The display panel is typically manufactured by bonding a first substrate serving as an array substrate on which a thin film transistor is formed and a pixel area is defined and a second substrate serving as an upper substrate or a protection substrate on which a black matrix and/or a color filter layer is formed.

The array substrate or first substrate on which the thin film transistor is formed includes a plurality of gate lines GL extended in a first direction and a plurality of data lines DL extended in a second direction that is perpendicular to the first direction, and each pixel P or sub-pixel SP is defined by a gate line and a data line. Within a pixel area P or sub-pixel area, one or more thin film transistors are formed, and a gate or source electrode of each of the thin film transistors may be connected to a gate line and a data line.

Also, the array substrate or first substrate includes a gate driver (e.g., driving circuit) or a data driving circuit provided in the non-active area or outside the panel to supply a gate signal and a data signal required for driving each pixel to each gate line and each data line. Typically, each of a plurality of sub-pixels defined at intersections between gate lines and data lines is configured to display one of red (R), green (G), and blue (B).

Meanwhile, a period in which a gate driving signal is applied to a single gate line may be referred to as a horizontal period H. Typically, during a horizontal period 1H, a data signal (source signal) is applied to three sub-pixels including R, G, and B and an image is displayed on the corresponding sub-pixels. As such, a change of image display between sub-pixels of respective colors may be referred to as a sub-pixel transition or a transition.

Meanwhile, the supply of a source signal to a data line needs to be dynamically switched to perform a sub-pixel transition and, thus, may affect image quality and power consumption. Therefore, it is necessary to optimize a transition method with consideration for display characteristics and power consumption.

SUMMARY

Accordingly, embodiments of the present disclosure are directed to a display device and a method of sub-pixel transition that substantially obviate one or more of the problems due to limitations and disadvantages of the related art.

An aspect of the present invention is to provide a display device capable of suppressing defective display during a sub-pixel transition in a display panel.

Another aspect of the present invention is to provide a display device capable of suppressing defective display caused by a sub-pixel transition by uniformly performing a transition between sub-pixels displaying different colors, and a method of transition.

Yet another aspect of the present invention is to provide a display device capable of reducing defective display caused by a sub-pixel transition by reducing a transition between sub-pixels, and a method of transition.

Still another aspect of the present invention is to provide a display device and a method of transition.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises a display panel including gate lines, data lines, a first color sub-pixel, a second color sub-pixel, and a third color sub-pixel, wherein the first color sub-pixel, the second color sub-pixel, and the third color sub-pixel are defined by intersections between the data lines and gate lines; a data driver configured to apply a source signal to the data lines; and a transition control unit configured to control a sequential supplying of the source signal to the first color sub-pixel, the second color sub-pixel, and the third color sub-pixel during a kth horizontal period H#k and a sequential supplying of the source signal to the third color sub-pixel, the first color sub-pixel, and the second color sub-pixel during a k+1th horizontal period H#(k+1).

In another aspect, a method of a sub-pixel transition in a display device, which includes a first color sub-pixel, a second color sub-pixel, and a third color sub-pixel, and a transition control unit configured to control transitions for the first, second, and third sub-pixels, comprises time-dividing a kth horizontal period into three sub-horizontal periods, and driving the first color sub-pixel during a first sub-horizontal period, the second color sub-pixel during a second sub-horizontal period, and the third color sub-pixel during a third sub-horizontal period; and time dividing a k+1th horizontal period into three sub-horizontal periods, and driving third sub-pixel during a first sub-horizontal period, the first color sub-pixel during a second sub-horizontal period, and the second color sub-pixel during a third sub-horizontal period.

In another aspect, a display device, comprises a display panel including gate lines, data lines, a first color sub-pixel, a second color sub-pixel, and a third color sub-pixel, wherein the first color sub-pixel, the second color sub-pixel, and the third color sub-pixel are defined by intersections between the data lines and gate lines; a data driver configured to apply a source signal to the data lines; a source multiplexer configured to switch a supply of the source signal to each of the data lines; and a transition control unit configured to control a sub-pixel transition to be performed by supplying an ON pulse to the source multiplexer to switch the supply of the source signal to one sub-pixel among the first, second, and third sub-pixels during a first sub-horizontal period of a kth horizontal period H#k, a second sub-horizontal period of a k+1th horizontal period H#(k+1), and a third sub-horizontal period of a k+2th horizontal period H#(k+2).

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
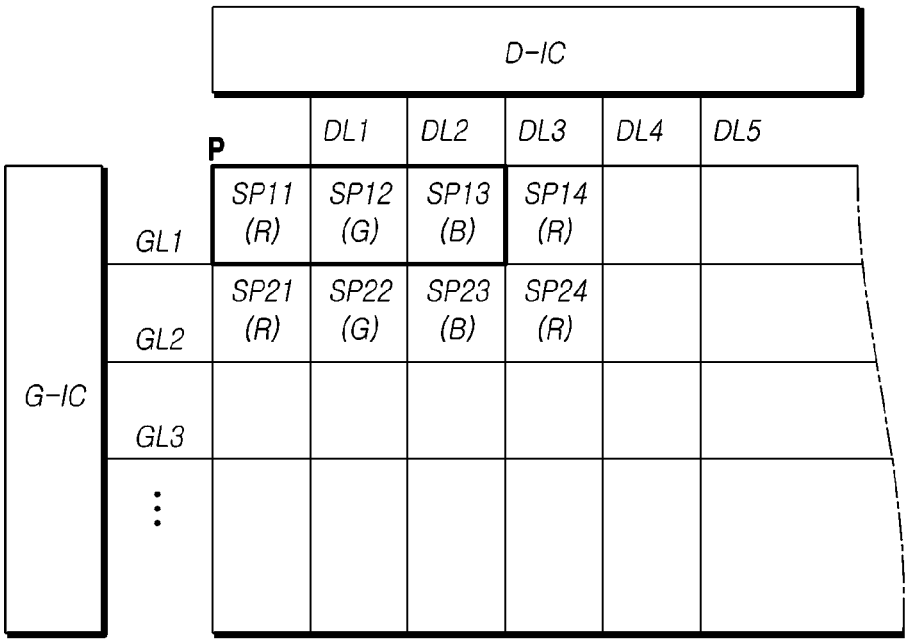
FIG. 1 is a plan view of a related art display panel and illustrates a structure in which a plurality of sub-pixels is formed.

Hereinafter, some embodiments of the present invention will be described in detail with reference to the accompanying drawings. When reference numerals refer to components of each drawing, although the same components are illustrated in different drawings, the same components are referred to by the same reference numerals as possible. Further, if it is considered that description of related known configuration or function may cloud the gist of the present invention, the description thereof will be omitted.

Further, in describing components of the present invention, terms such as first, second, A, B, (a), and (b) can be used. These terms are used only to differentiate the components from other components. Therefore, the nature, order, sequence, or number of the corresponding components is not limited by these terms. It is to be understood that when one element is referred to as being "connected to" or "coupled to" another element, it may be directly connected to or directly coupled to another element, connected to or coupled to another element, having still another element "intervening" therebetween, or "connected to" or "coupled to" another element via still another element.

FIG. 1 is a plan view of a related art display panel and illustrates a structure in which a plurality of sub-pixels is formed.

As illustrated in FIG. 1, in a related art display panel, a plurality of gate lines GL and data lines DL is formed, and a pixel or sub-pixel is defined by each intersection between a gate line and a data line.

If the display panel has a mono-structure, a single intersection constitutes a single pixel. However, in a related art color display panel, each intersection constitutes a sub-pixel SP that displays image data of one of colors R, G, and B, and three sub-pixels of three colors can be defined as a single pixel.

On an array substrate of each sub-pixel area, one or more thin film transistors are formed. The thin film transistors are switched in response to a gate driving signal or gate clock (Gate CLK) supplied to a gate line and a source signal supplied to a data line so as to supply an electric field to the corresponding sub-pixel and thus drive a light emitting diode disposed in the sub-pixel. Meanwhile, a display device may include a gate driver G-IC disposed inside or outside the display panel and configured to supply a gate driving signal to a gate line and a data driver D-IC configured to supply a source signal to a data line while controlling the gate driver.

An image output method of the display device is as follows.

Firstly, a total of 'm' number of gate lines and 'n' number of data lines may be disposed in the display panel. A period in which a gate driving signal is supplied to a single gate line may be defined as a horizontal period 1H. During a horizontal period, the data driver D-IC supplies a source signal in a batch to the n number of data lines to display an image. That is, an image is output to a total of n number of sub-pixels disposed on the gate lines during a horizontal period.

Meanwhile, in a display panel configured to display three or more colors, a horizontal period may be divided into three sub-horizontal periods (or could be alternatively referred to as horizontal sub-periods), and then, an image of only one specific color may be displayed during each sub-horizontal period.

For example, as illustrated in FIG. 1, if it is assumed that R sub-pixels are formed on data lines 1, 4, 7, and the like, G sub-pixels are disposed on data lines 2, 5, 8, and the like, and B sub-pixels are formed on data lines 3, 6, 9, and the like, a gate driving signal is applied to a first gate line GL1 during a first horizontal period H1 and a source signal may be applied only to the data lines 1, 4, 7, and the like during a first sub-horizontal period $1^{st}$ ⅓H to drive the R sub-pixels, applied only to the data lines 2, 5, 8, and the like during a second sub-horizontal period $2^{nd}$ ⅓H to drive the G sub-pixels, and applied only to the data lines 3, 6, 9, and the like during a third sub-horizontal period $3^{rd}$ ⅓H to drive the B sub-pixels.

As such, if the sub-pixels of the respective colors are driven in a time division manner, a switching unit configured to switch the application of a source signal to each data line needs to be added. The switching unit may be implemented as a transistor such as an FET.

According to the above-described image output method, a switching unit corresponding to each data line needs to be ON/OFF controlled in synchronization with each sub-horizontal period, and first color sub-pixel driving needs to be switched to second color sub-pixel driving. Such a driving switch for each color may be defined as a sub-pixel transition or simply as a transition.

Figure 2:
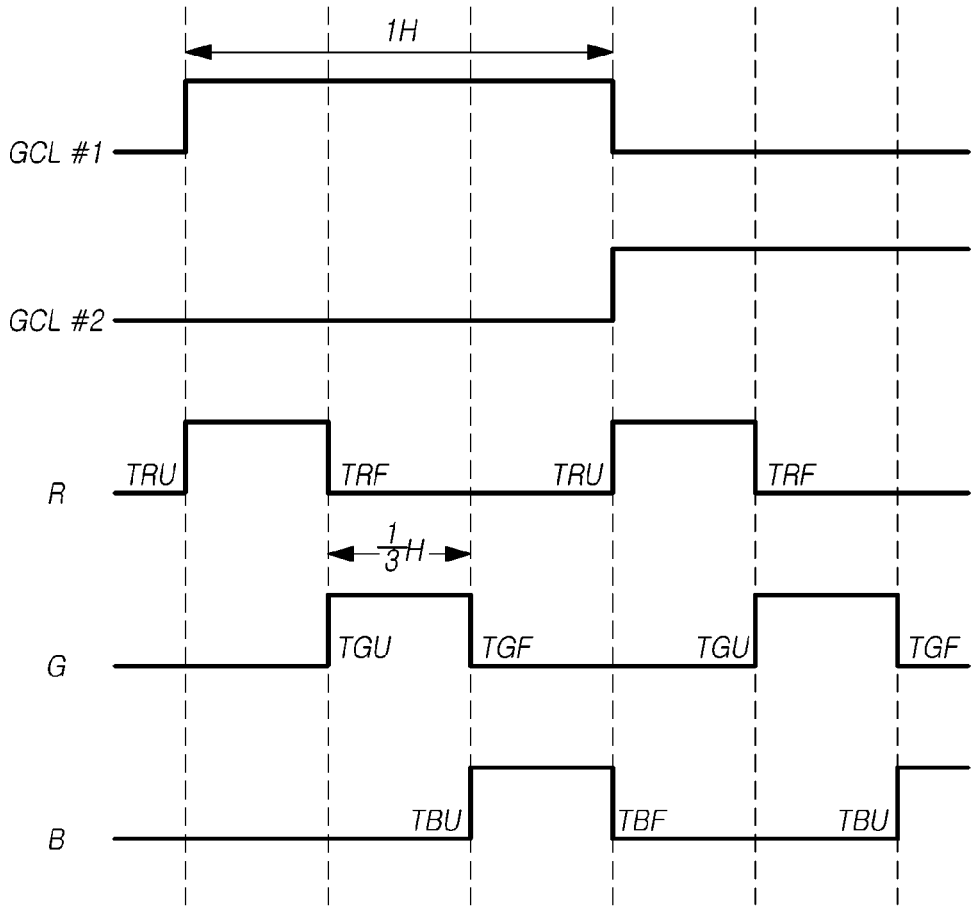
FIG. 2 illustrates a related art sub-pixel transition method in the display panel as illustrated in FIG. 1.

FIG. 2 illustrates a signal timing chart of a related art sub-pixel transition in the display panel as illustrated in FIG. 1.

As illustrated in FIG. 2, in a state where a gate driving signal GCL#1 is supplied to a first data line during a horizontal period, a control pulse for switching a R sub-pixel driving is applied during a first sub-horizontal period $1^{st}$ ⅓H of the horizontal period, and then, control pulses for driving G and B sub-pixels are applied during second and third sub-horizontal periods.

In the illustrated example, a rising transition and a falling transition of a control pulse for R sub-pixel driving are denoted as TRU and TRF, respectively, and rising and falling transitions for G and B are also denoted in the same manner (TGU, TGF, TBU, and TBF). In the transition method illustrated in FIG. 2, a total of two transitions including a rising transition and a falling transition are performed to each color during a horizontal period.

Such a transition needs to control the corresponding switching unit. Therefore, as the number of transitions performed to all the colors during the same period (for example, 1 frame, and the like) is increased, complexity of control is increased and power consumption is also increased.

Therefore, a method for reducing the number of sub-pixel transitions in the driving method for each color may be provided. A method of reducing the number of transitions as compared with a related art method in which two transitions are performed to each color during a horizontal period will be referred to as a "less transition."

Figure 3A:
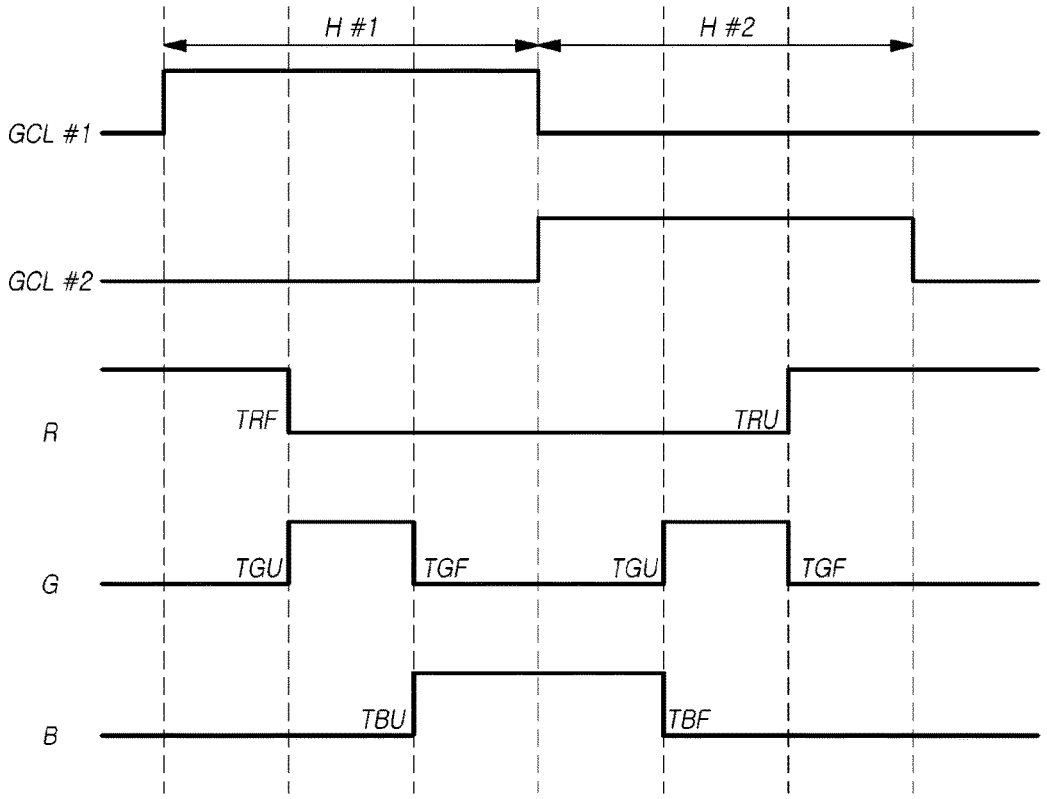
FIGS. 3A and 3B illustrate an example of a less transition method for reducing the number of transitions for each color.
Figure 3B:
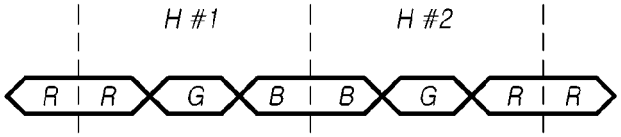

FIGS. 3A and 3B illustrate an example of a less transition method for reducing the number of transitions for each color.

In this less transition method, a color driven during a last sub-horizontal period of a kth horizontal period H#k is disposed so as to be driven during a first horizontal period of a k+1th horizontal period H#(k+1). Thus, the overall number of transitions can be reduced.

As an example of the less transition method, FIGS. 3A and 3B illustrate that when which sub-pixel colors to be displayed during a 1 sub-horizontal period are denoted as R, G, and B in sequence, colors are repeatedly displayed in order of RGB, BGR, and RGB. That is, colors driven during a kth horizontal period are disposed in reverse order of colors driven during a previous (k−1)th horizontal period.

FIG. 3A is a signal timing chart according to the less transition method, and FIG. 3B illustrates colors of an image displayed in sequence.

In the less transition method, as illustrated, during two horizontal periods, the number of transitions to G is a total of four (two rising transitions and two falling transitions) equal to the numbers as illustrated in FIG. 1 and FIG. 2 and the number of transition to each of R and B is a total of two (one rising transition and one falling transition) decrease as compared with the numbers as illustrated in FIG. 1 and FIG. 2.

As a result, during two horizontal periods, a total of twelve transitions are performed to all the three colors in the related art transition method as illustrated in FIG. 1 and FIG. 2, whereas a total of only eight transitions (four transitions to G color and two transitions to each of R and B colors) are performed to all the three colors in the less transition method as illustrated in FIGS. 3A and 3B. Therefore, the number of transitions is reduced by 33%.

However, in the less transition method as illustrated in FIGS. 3A and 3B, the number of transitions varies depending on a color. Therefore, display characteristics of each color may be changed.

That is, in FIGS. 3A and 3B, a total of two transitions are performed to each of R and B during two horizontal periods and a total of four transitions are performed to G during two horizontal periods, and, thus, G may have image output characteristics different from those of R and B.

In general, if a switching unit for driving each color (sub-pixel) is turned OFF, i.e., if a falling transition is performed, there is a driving voltage change which is referred to as a kick back voltage, and the kick back voltage causes temporary flicker or image sticking.

Particularly, in a liquid crystal display, an inversion method for inverting the polarity of a driving voltage in each frame may be employed to suppress degradation of a liquid crystal caused by long-time application of a unidirectional electric field to the liquid crystal. For example, various inversion methods such as a frame inversion method, a line inversion method, a column inversion method, or a dot inversion method has been applied. Particularly, the column inversion method is a method of changing the polarity in each column (vertical line). In the column inversion method, the polarity of R, G, and B data is inverted.

If the inversion method is employed, a switching unit is switched between −9 V (or 5.2 V) and +9 V (or +5.2 V) and a difference in kick back voltage caused by the above-described falling transition is gradually increased. Therefore, the above-described defective display may be further increased.

Particularly, if a frame frequency generally indicating the number of frames in one second is 60 Hz to 120 Hz, defective display may not considerably appear. However, recently, in a mobile display, a frame frequency can be lowered to about 30 Hz or less during an operation of outputting a still image or document to reduce power consumption. In this case, flicker or image sticking caused by a difference in number of transitions for each color may cause highly defective display.

Accordingly, in the following example embodiment, a less transition method in which the number of transitions for each color can be equalized will be suggested.

Figure 4:
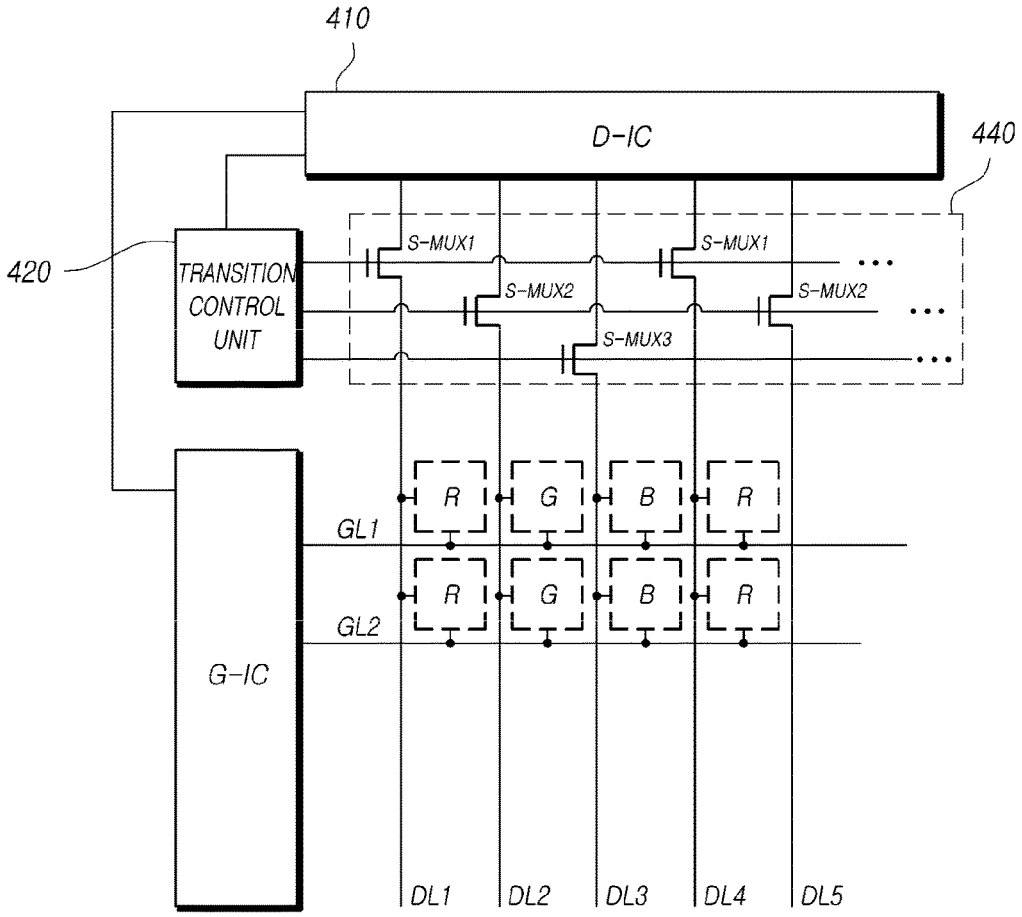
FIG. 4 is a plan view of a display panel including a less transition method according to an example embodiment.
Figure 5:
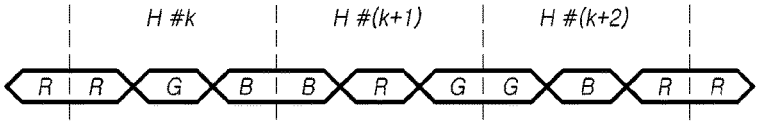
FIG. 5 illustrates an order of displaying colors according to the less transition method according to an example embodiment.

FIG. 4 is a plan view of a display panel including a less transition method according to an example embodiment, and FIG. 5 illustrates an order of displaying colors according to the less transition method according to an example embodiment.

As illustrated in FIG. 4, a display device according to the present exemplary embodiment is configured to perform a new less transition method and includes a display panel including gate lines and data lines and sub-pixels of respective colors defined by intersections between the data lines and the gate lines, a data driver (D-IC) 410 configured to apply a source signal to the data lines, and a transition control unit 420 configured to perform a less transition according to the present exemplary embodiment under the control of the data driver.

The transition control unit performs a control to sequentially supply a first color sub-pixel, a second color sub-pixel, and a third color sub-pixel with a corresponding source signal during a kth horizontal period and sequentially supply the third color sub-pixel, the first color sub-pixel, and the second color sub-pixel with a corresponding source signal during a k+1th horizontal period.

For example, if it is assumed that a first color is R, a second color is G, and a third color is B, then R, G, and B sub-pixels are sequentially driven during a first horizontal period and B, R, and G sub-pixels are sequentially driven during a second horizontal period.

That is, in the less transition method as illustrated in FIG. 3, driving is performed in reverse order of the driving performed in a previous horizontal period, whereas in the example embodiment as illustrated in FIG. 3, a last color of a previous horizontal period is first driven and then the other colors except the last color of the previous horizontal period are sequentially driven.

According to this example embodiment, an equivalent reduction (33%) of number of transitions compared with the related art transition (of FIG. 1 and FIG. 2) can be secured as illustrated in FIG. 3. Also, the same number of transitions is performed to each color. Thus, it is possible to suppress defective display caused by a difference in number of transitions for each color as illustrated in FIG. 3.

The effect of the present exemplary embodiment will be described below in more detail with reference to FIG. 6.

Meanwhile, in the exemplary embodiment as illustrated in FIG. 4, the display device further includes a source multiplexer 440 configured to switch the supply of a source signal to each data line. The transition control unit performs the above-described less transition by controlling the source multiplexer.

The source multiplexer includes a plurality of switching elements, S-MUX, connected to each data line. The S-MUX may be applied with an S-MUX control signal capable of controlling ON/OFF of the S-MUX. The application of S-MUX control signal may be controlled by the data driver D-IC or the transition control unit 420.

As illustrated in FIG. 4, the switching elements, S-MUX, are disposed between the data driver (D-IC) 120 and each data line. The S-MUX may be configured as a thin film transistor TFT. More specifically, a pixel PIXEL may include three sub-pixels including an R sub-pixel, a G sub-pixel, and a B sub-pixel. The sub-pixels are connected to data lines DL1 to DL3, respectively, and the first gate line GL1.

To output an image, a first scan signal is applied to a first gate line during a horizontal period H. At the same time, a first source signal, a second source signal, and a third source signal are applied in sequence to a first data line DL1, a second data line DL2, and a third data line DL3, respectively.

In the related art transition method, as illustrated in FIG. 1 and FIG. 2, a horizontal period is divided into three sub-horizontal periods. During a first sub-horizontal period, n+1th data lines (n=0, 1, 2 . . . ) are simultaneously applied with the corresponding source signal, and, thus, an image is output to all of R sub-pixels in the display panel. During a second sub-horizontal period, n+2th data lines (n=0, 1, 2 . . . ) are simultaneously applied with the corresponding source signal, and, thus, an image is output to all of G sub-pixels in the display panel. During a third sub-horizontal period, n+3th data lines (n=0, 1, 2 . . . ) are simultaneously applied with the corresponding source signal, and, thus, an image is output to all of B sub-pixels in the display panel.

However, with the less transition according to the example embodiment, if an image is output by the transition control unit 420 during a first sub-horizontal period of a kth horizontal period for one color, driving may be performed to output the image during a second horizontal period of a k+1th horizontal period H#(k+1) and a third sub-horizontal period of a k+2th horizontal period H#(k+2).

That is, as illustrated in FIG. 5, if driving is performed to display the image in order of RGB during the kth horizontal period, the image is displayed in order of BRG during the k+1th horizontal period and in order of GBR during the k+2th horizontal period. As a result, driving is performed in order of RGB, BRG, and GBR.

To this end, it is necessary to control ON/OFF of each S-MUX so as to apply a source signal only to the corresponding data line during each sub-horizontal period. The transition control unit 420 performs an operation of selectively turning ON one of S-MUX1 to S-MUX3 according to the above-described transition rule. The S-MUX structure makes it possible to effectively control a transition according to the present exemplary embodiment.

That is, a transition driver performs a control to supply an ON pulse to an S-MUX1(R) during the first sub-horizontal period of the kth horizontal period, the second horizontal period of the k+1th horizontal period H#(k+1), and the third sub-horizontal period of the k+2th horizontal period H#(k+2) for R color so as to turn on the S-MUX1, and turn off the S-MUX2(G) and the S-MUX3(B) during that time. The color driven in the above-described order is not necessarily R, and G or B may be the color.

Figure 7:
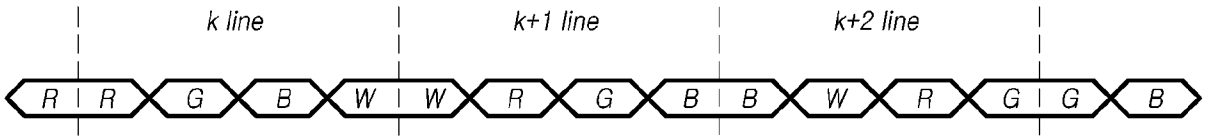
FIG. 7 illustrates an order of displaying colors according to a less transition method according to another example embodiment.

Also, as illustrated in FIG. 7, in case of the pixel including sub-pixels of four colors such as W, R, G, and B, if the S-MUX1 is turned ON during the first sub-horizontal period of the kth horizontal period for a specific color (R from among W, R, G, and B), driving may be performed to turn ON the S-MUX1 during the second horizontal period of the k+1th horizontal period, the third sub-horizontal period of the k+2th horizontal period, and a fourth sub-horizontal period of a k+3th horizontal period and turn OFF the others S-MUX2(G), S-MUX3(B), and S-MUX4(W).

To this end, an S-MUX control signal (S-MUXi control signal; i=1, 2, 3) or a transition control signal is applied to each S-MUX through a control line. The transition control signal may be generated by the data driver 410 or a separate timing controller and then applied. Meanwhile, the source multiplexer 440 has a concept including all kinds of elements or circuits disposed between the respective data lines and the data driver and configured to switch the application of a source signal from the data driver to the corresponding data line.

Although FIG. 4 illustrates that the transition control unit 420 is separate from the data driver 410, the transition control unit 420 may be implemented to be included in the data driver.

Also, the display panel included in the display device according to the present exemplary embodiment is not limited to a specific type. All kinds of display panels such as a liquid crystal display, an organic light emitting diode (OLED) display device, a plasma display panel, and an electrophoretic display device may be used as long as they include sub-pixels for displaying three or more colors and have transitions for each color.

Figure 6:
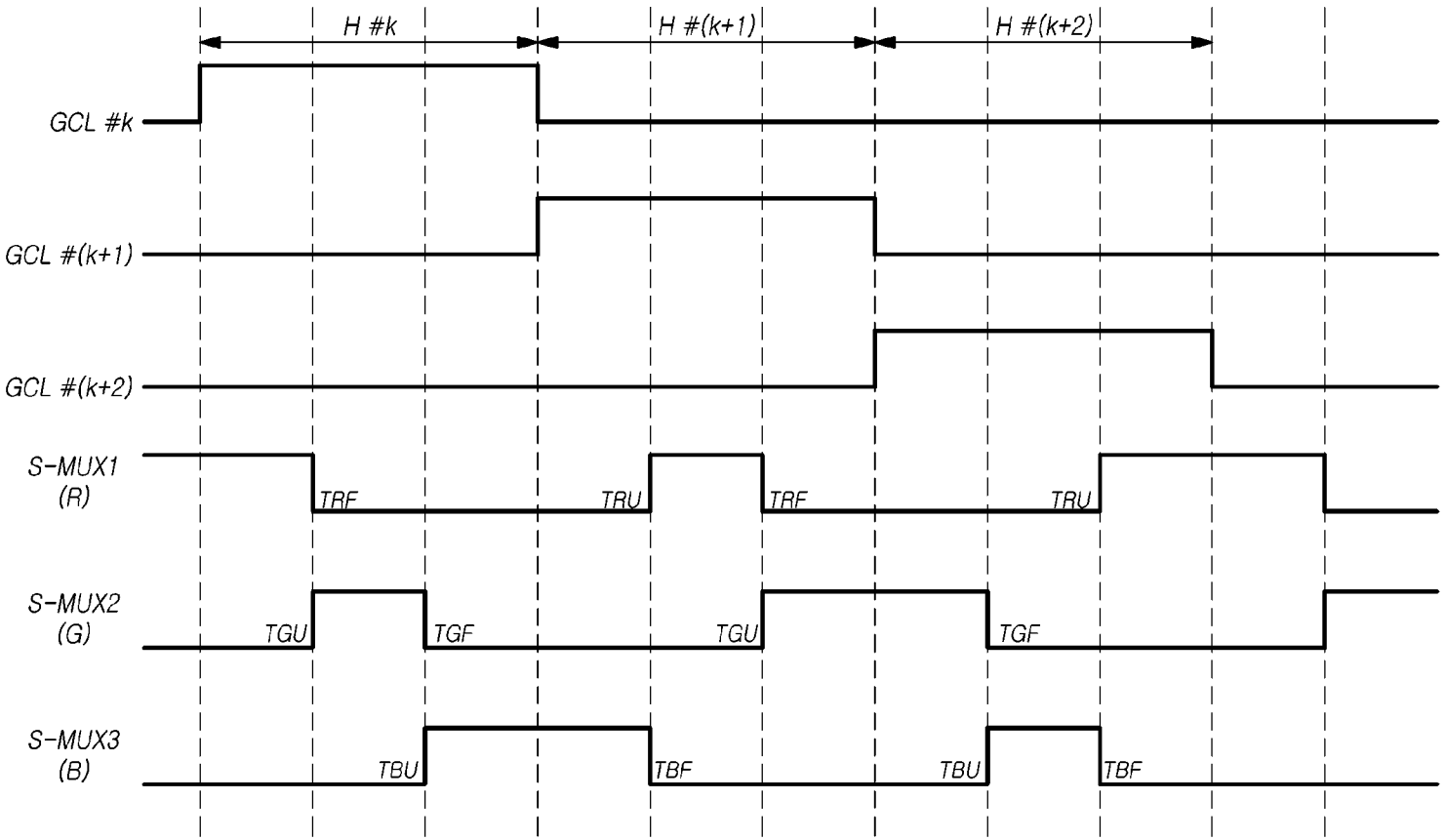
FIG. 6 illustrates a signal timing chart for implementing a less transition according to an example embodiment.

FIG. 6 illustrates a signal timing chart for implementing a less transition according to an example embodiment.

As illustrated in FIG. 6, the transition control unit 420 according to the example embodiment applies an ON pulse to the S-MUX1 during a first sub-horizontal period $1^{st}$ ⅓H in a state where a gate driving clock GCL #k is applied to a kth gate line during the kth horizontal period H#k, and, thus, supplies a source signal to a total of 3/n number of R sub-pixels. Thereafter, during a second sub-horizontal period $2^{nd}$ ⅓H, the transition control unit 420 applies an ON pulse to the S-MUX2(G), and, thus, supplies the source signal to G sub-pixels. Thereafter, during a third sub-horizontal period $3^{rd}$ ⅓H, the transition control unit 420 applies an ON pulse to the S-MUX3(B), and, thus, supplies the source signal to B sub-pixels.

Then, during the k+1th horizontal period, the transition control unit 420 applies an ON pulse to the S-MUX3(B) during a first sub-horizontal period $1^{st}$ ⅓H in a state where a gate driving clock GCL #k+1 is applied to a k+1th gate line, and, thus, supplies the source signal to a total of 3/n number of B sub-pixels. As a result, the B sub-pixels are continuously driven without a transition from the third sub-horizontal period $3^{rd}$ ⅓H of the kth horizontal period H#k to the first sub-horizontal period $1^{st}$ ⅓H of the k+1th horizontal period H#(k+1).

Then, during a second horizontal period $2^{nd}$ ⅓H of the k+1th horizontal period, the transition control unit 420 supplies an ON pulse to the S-MUX1(R) so as to apply the source signal to R sub-pixels driven during the first sub-horizontal period of the previous horizontal period unlike the less transition, as illustrated in FIG. 3.

Then, during a third horizontal period 3rd ⅓H of the k+1th horizontal period, the transition control unit 420 supplies an ON pulse to the S-MUX2(G) so as to apply the source signal to G sub-pixels driven during the second sub-horizontal period of the previous horizontal period unlike the less transition, as illustrated in FIG. 3.

Then, during the k+2th horizontal period, the transition control unit 420 applies an ON pulse to the S-MUX2(G) during a first sub-horizontal period $1^{st}$ ⅓H in a state where a gate driving clock GCL #k+2 is applied to a k+2th gate line, and, thus, supplies the source signal to a total of 3/n number of G sub-pixels. As a result, the G sub-pixels are continuously driven without a transition from the third sub-horizontal period $3^{rd}$ ⅓H of the k+1th horizontal period to the first sub-horizontal period $1^{st}$ ⅓H of the k+2th horizontal period.

Then, during a second horizontal period 2nd ⅓H of the k+2th horizontal period, the transition control unit 420 supplies an ON pulse to the S-MUX3(B) so as to apply the source signal to B sub-pixels driven during the first sub-horizontal period of the previous k+1th horizontal period unlike the less transition, as illustrated in FIG. 3.

Further, during a third horizontal period $3^{rd}$ ⅓H of the k+2th horizontal period, the transition control unit 420 supplies an ON pulse to the S-MUX1(R) so as to apply the source signal to R sub-pixels driven during the second sub-horizontal period of the k+1th horizontal period unlike the less transition as illustrated in FIG. 3.

As a result, during the three horizontal periods from the kth to k+2th horizontal periods, driving is performed in order of RGB, BRG, and GBR, and from the subsequent k+3th horizontal period, driving is repeated in the above-described order. In other words, a color continuously driven from a starting point of the kth horizontal period H#k without a transition is also continuously driven during the k+3th horizontal period without a transition.

According to the above-described transition method, a total of four transitions, i.e., two rising transitions and two falling transitions, are performed to each color during three horizontal periods, as illustrated in FIG. 6. That is, a total of four transitions are performed to each of three colors in the same manner, and, thus, a total of twelve transitions are performed to all of the colors.

Therefore, as compared with the related art transition method as illustrated in FIG. 1 and FIG. 2 in which a total of six transitions (three rising transitions and three falling transitions) are performed to each color during a total of three horizontal periods, and, thus, a total of eighteen transitions are performed to all of the colors, the number of transitions is reduced by 33%. That is, according to the less transition method of the example embodiment, the reduction of number of transitions equivalent to the reduction (33%) as illustrated in FIG. 3 can be achieved and the same number of transitions is performed to each color unlike the less transition as illustrated in FIG. 3.

Thus, it is possible to suppress defective display caused by a difference in number of transitions for each color of the less transition method as illustrated in FIG. 3.

Particularly, according to the example embodiment, as illustrated in FIG. 6, each color has the same total number of transitions and also has the same number of falling transitions which cause defective display. Therefore, defective display caused by a difference in number of transitions for each color does not occur fundamentally. In short, according to the example embodiment, the reduction of number of transitions equivalent to the reduction (33%) as illustrated in FIG. 3 can be achieved and defective display can be suppressed by equalizing the number of transitions for each color.

FIG. 7 illustrates an order of displaying colors according to a less transition method according to another exemplary embodiment.

In the example embodiment described with reference to FIG. 4 through FIG. 6, the sub-pixels have three colors R, G, and B. The concept of the present invention is not limited thereto and can be applied to a display device including sub-pixels of four or more colors in a similar manner.

In an RGB organic light emitting diode (OLED) display device, all of sub-pixels of three colors R, G, and B may be turned on to express a white color. Therefore, a display panel has low durability with low efficiency, and, thus, may not be suitable for a large-size display panel. To solve the above-described problem, a so-called WRGB organic light emitting diode display panel further including a white (W) sub-pixel in addition to R, G, and B sub-pixels may be used.

FIG. 7 illustrates an example embodiment where the sub-pixels have four colors W, R, G, and B.

If a first color sub-pixel to a fourth color sub-pixel are included, the transition control unit according to the example embodiment may sequentially supply a source signal to a first color, a second color, a third color, and a fourth color during the kth horizontal period H#k. In this case, sub-pixels are driven in order of the fourth color, the first color, the second color, and the third color during the k+1th horizontal period. FIG. 7 illustrates an example where the less transition method according to the example embodiment is applied to a display panel in which sub-pixels of four colors are disposed in order of R, G, B, and W.

In this case, the kth horizontal period H#k is divided into four horizontal periods (¼H) and then driving is performed in order of R, G, B, and W during the respective sub-horizontal periods. Then, during the k+1th horizontal period, driving is performed in order of W, R, G, and B, and during the k+2th horizontal period, driving is performed in order of B, W, R, and G. Then, during the k+3th horizontal period, driving is performed in order of G, B, W, and R. Then, from a subsequent k+4th horizontal period, driving is repeated in the above-described order of the kth to k+3th horizontal periods.

Therefore, a total of five transitions are performed to each color in the same manner during the four horizontal periods. As such, the example embodiment can be applied to the case where sub-pixels of three or more colors are included, and can reduce the number of transitions and can also suppress defective display caused by a difference in display characteristics of each color by equalizing the number of transitions for each color.

Figure 8:
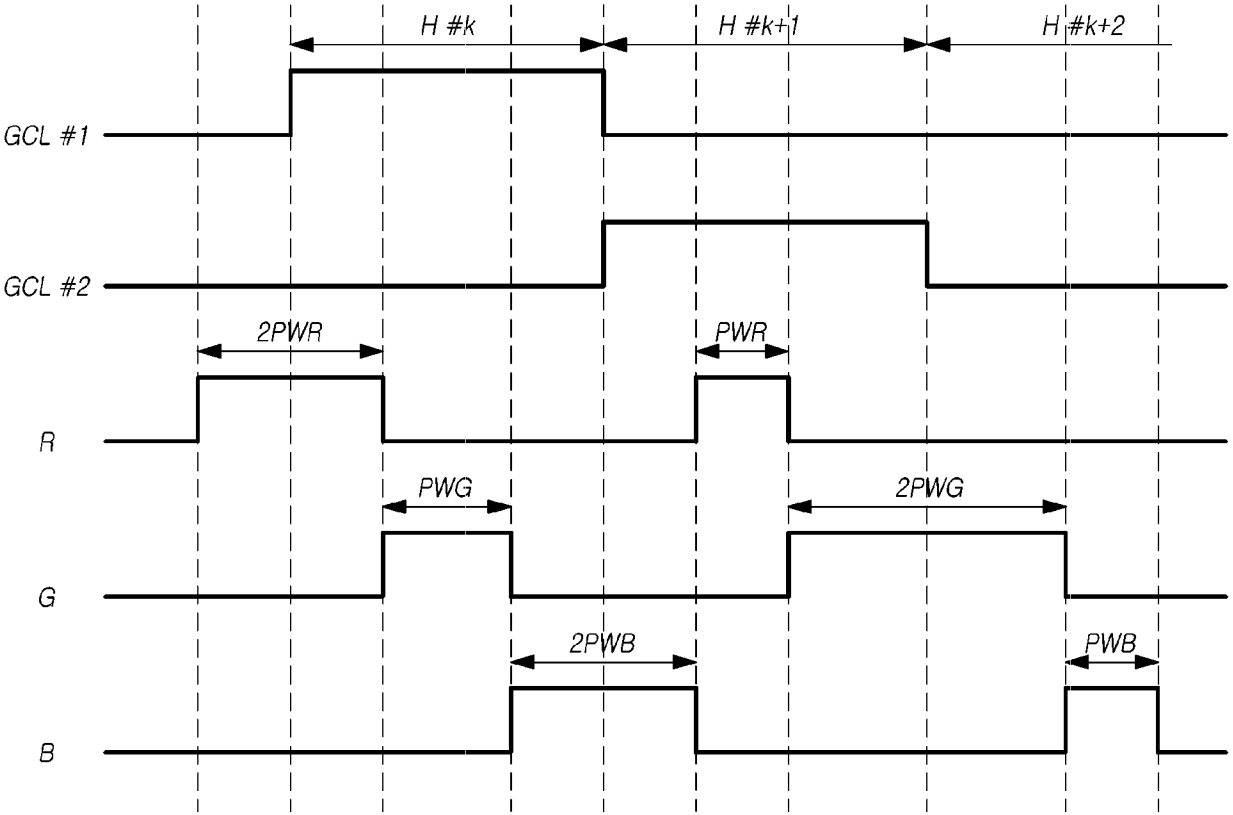
FIG. 8 illustrates a less transition method according to yet another exemplary embodiment and illustrates an exemplary embodiment in which a different ON pulse width is set for each color.

FIG. 8 illustrates a less transition method according to yet another exemplary embodiment and illustrates an exemplary embodiment in which a different ON pulse width is set for each color.

In the example embodiments illustrated up to FIGS. 3-7, widths of ON pulses for respective colors are equal to each other. That is, in the exemplary embodiments illustrated up to FIG. 7, driving is controlled for each of sub-horizontal periods divided from a horizontal period in the same number as the number of colors.

However, if a data voltage output to R, G, and B pixels is inverted by the above-described inversion function, holding timing for a green (G) data voltage may be reduced as compared with the other colors. That is, if a transition is performed in a display device driven by the column inversion method, the polarity of a data voltage output to an R sub-pixel, a G sub-pixel, and a B sub-pixel adjacent to each other is changed. Therefore, although the polarity of a data voltage output to the R sub-pixel is the same as the polarity of a data voltage output to the B sub-pixel, the polarity of a data voltage output to the G sub-pixel is opposite to the polarity of the R and B data voltages.

Therefore, considering a period GR required for a change to ground and a period P required for a change of polarity, a period in which a data voltage is actually output during an ON-pulse section for driving the corresponding S-MUX may be shorter in G than in R and B.

That is, G in the middle of a change between different polarities has a shorter data voltage holding time (source holding time) than an actual input due to a delay caused by rising/falling transitions. Particularly, the G color more highly affects the luminance than the R and B colors. Therefore, a relatively short holding time of the G color as described above may cause a decrease in luminance.

Accordingly, in the example embodiment, the less transition method as illustrated in FIG. 6 is employed, but an ON-pulse width of an S-MUX controlling G sub-pixels may be set to be greater than an ON-pulse width for controlling R and B sub-pixels.

That is, as illustrated in FIG. 8, an order of sub-pixel transition for each color is the same as that of the exemplary embodiment as illustrated in FIG. 6, but when setting sub-horizontal periods for each color in a horizontal period, an ON-pulse width PWG of an S-MUX2 control signal for driving G sub-pixels is set to be greater than ON pulse widths PWR and PWB of S-MUX1(R) and S-MUX3(B) for controlling R and B sub-pixels.

To this end, the transition control unit according to the present exemplary embodiment divides the kth horizontal period into three sub-horizontal periods and controls a width of a second sub-horizontal period corresponding to driving of G sub-pixels to be greater than widths of first and third sub-horizontal periods.

Likewise, a horizontal period for driving the k+1th gate line is divided in order for a third sub-horizontal period corresponding to driving of G sub-pixels to be greater than first and second sub-horizontal periods.

As such, the transition control unit according to the example embodiment as illustrated in FIG. 8 separately performs an operation of controlling an order of transitions and an operation of controlling a sub-horizontal period corresponding to driving of G sub-pixels to be greater than sub-horizontal periods for R and B sub-pixels in each horizontal period at the same time. According to the example embodiment as illustrated in FIG. 8, a data voltage holding time of G sub-pixels can be adjusted to be equivalent to those of R and B sub-pixels, and, thus, the luminance can be maintained in an inversion-type display device.

Figure 9:
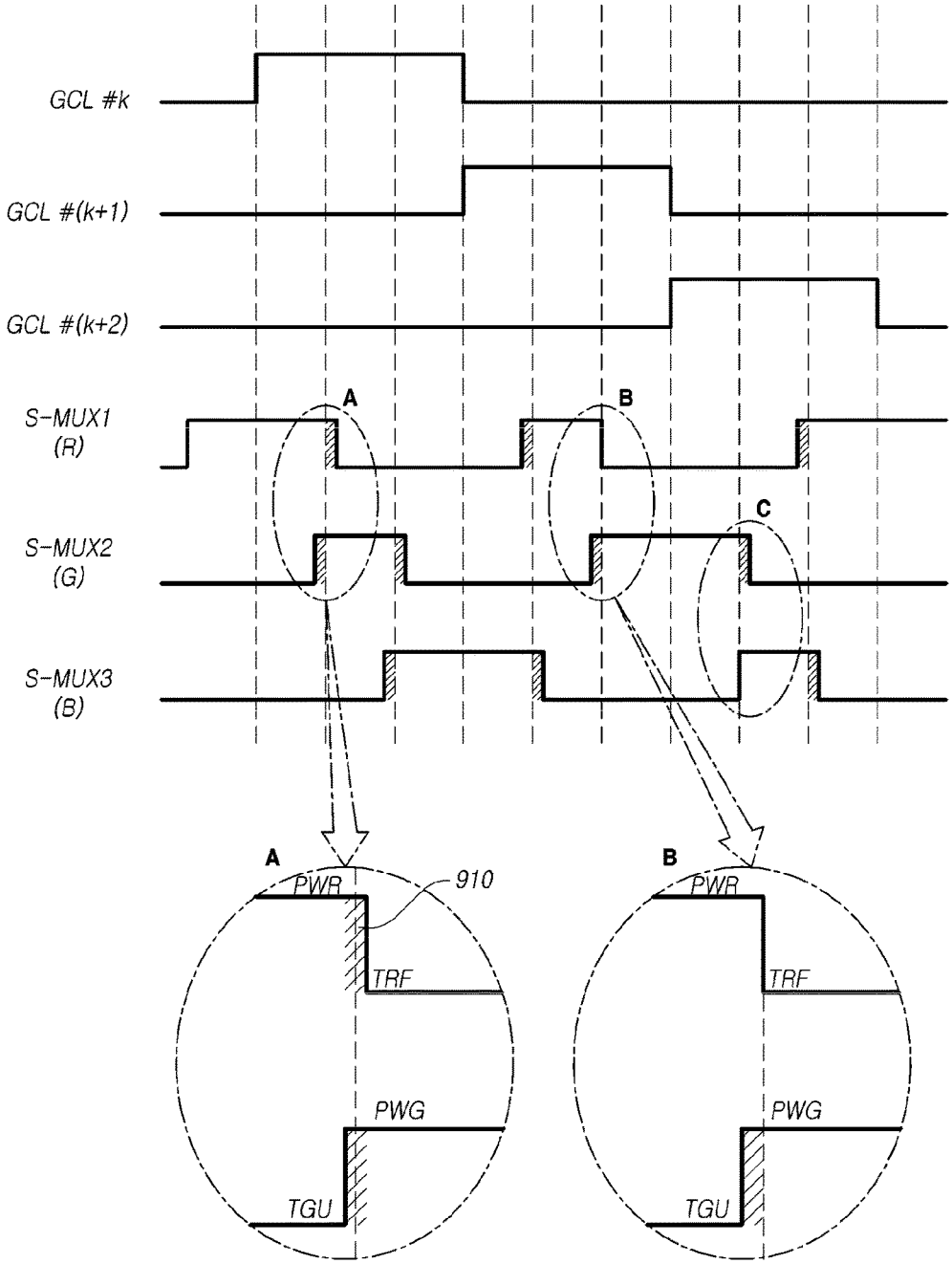
FIG. 9 illustrates a less transition method according to still another exemplary embodiment and illustrates a configuration in which ON pulses of respective colors are partially overlapped.

FIG. 9 illustrates a less transition method according to still another example embodiment and illustrates a configuration in which ON pulses of respective colors are partially overlapped.

To meet a recent demand for larger display devices with higher resolution, there is a desire to drive more sub-pixels at the same time. Therefore, a charging time for image display is not sufficient for each sub-pixel, which may result in deterioration of image quality.

Particularly, if a source multiplexer configured to switch the application of a source signal to each sub-pixel is used as illustrated in FIG. 6, the insufficient charging time may become a more sensitive issue due to a delay of a switching element occurring during a transition.

Therefore, in the example embodiment as illustrated in FIG. 9, ON pulses for driving the S-MUX for transition control are partially overlapped to partly improve such deterioration of image quality.

In the example embodiment of FIG. 9, the transition control unit controls ON pulse of two colors in transition to be partially overlapped. For example, during a R-G transition process as a first transition in the kth horizontal period, the transition control unit controls a rising transition TGU of the S-MUX2(G) to occur before the occurrence of a falling transition TRF of the S-MUX1(R).

As a result, in a transition from a first color to a second color, there is an overlap section 910 between a falling transition timing of the first color and a rising transition timing of the second color.

In this configuration, even if an image output frequency is increased, a sufficient charging time for each sub-pixel is secured. Thus, it is possible to suppress a decrease in luminance. Also, in a case of a transition to a G color by the combination of the exemplary embodiment illustrated in FIG. 9 and the exemplary embodiment illustrated in FIG. 8, the configuration of a partial overlap between ON pulses may be employed.

That is, if the inversion function is used, the G color most affects the luminance due to a reduction in holding time caused by inversion of a data voltage. Therefore, ON pulse widths can be controlled to be partially overlapped in a transition related to the G color.

For example, like the areas indicated by B and C in FIG. 9, sub-horizontal periods are equally divided and ON pulses for R and B colors are synchronized with the divided sub-horizontal periods, and a start timing of a rising transition TGU of the G color may be controlled to occur before the occurrence of a falling transition TRF of the R color and a falling transition TGF of the G color may be controlled to occur before the occurrence of a rising transition TBU of the B color. In this configuration, a decrease in luminance of the G color occurring in the inversion method can be reduced without an additional control to asymmetrically divide sub-horizontal periods.

Figure 10:
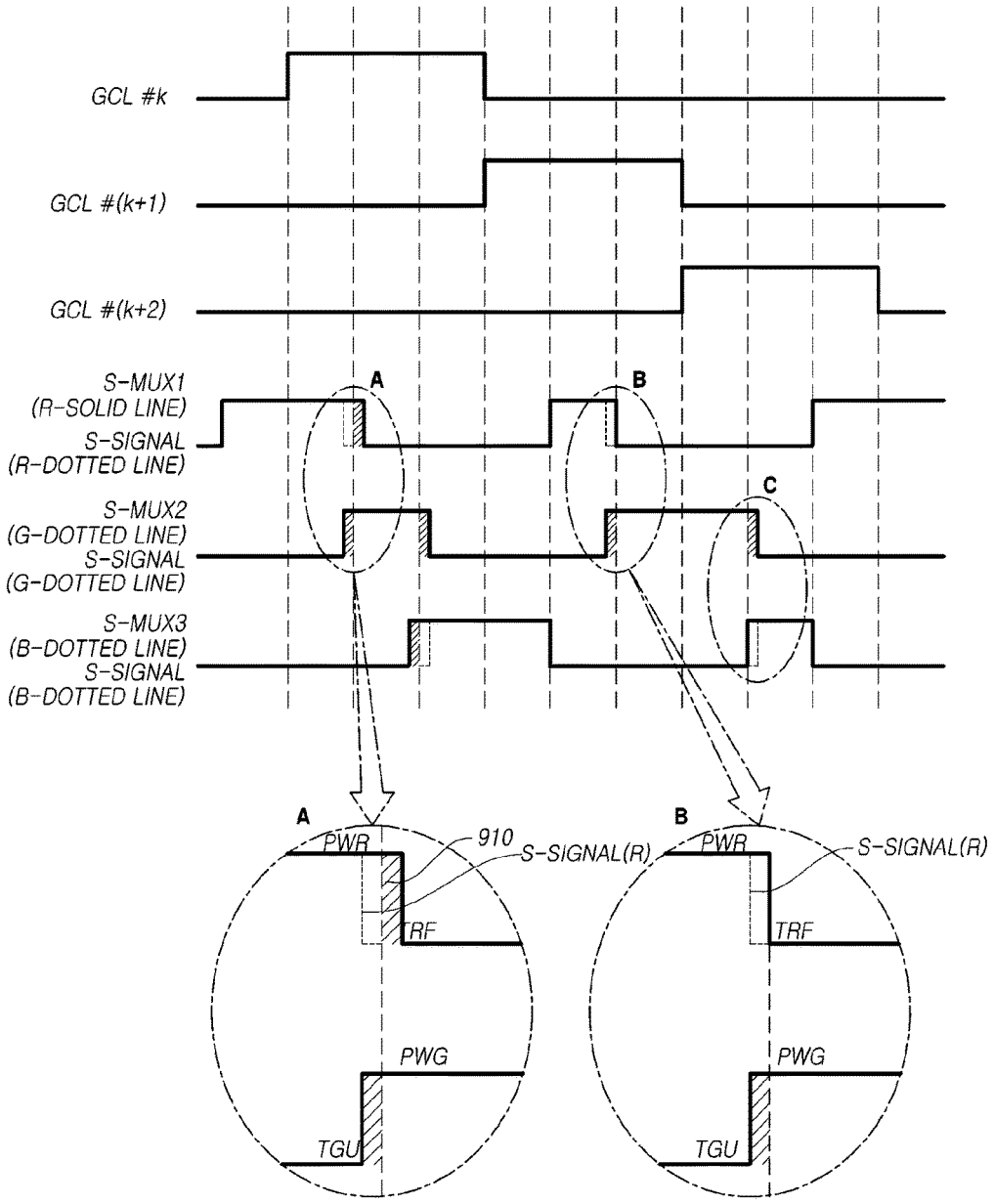
FIG. 10 illustrates a less transition method according to a modification example of FIG. 9 and illustrates a configuration in which S-MUX ON pulses of respective colors are partially overlapped and ON periods of source signals for the respective colors in transition are adjusted.

FIG. 10 illustrates a less transition method according to a modification example of FIG. 9 and illustrates a configuration in which S-MUX ON pulses of respective colors are partially overlapped and ON periods of source signals for the respective colors are adjusted to suppress color mixing.

That is, as illustrated in FIG. 9, if ON periods of S-MUXs are set to be partially overlapped to secure a charging time, there may be mixing of colors.

To overcome this problem, as illustrated in FIG. 10, ON periods of S-MUXs are set to be partially overlapped for each color so as to secure a charging time, but ON periods of source signals for the respective colors during sub-horizontal periods are set not to be overlapped with each other. Thus, color mixing can be suppressed.

FIG. 10 illustrates that ON periods of S-MUXs are set to be partially overlapped during a period of a transition to the G color but ON periods (indicated by a dotted line in FIG. 10) of source signals for the R and B colors are set not to be overlapped with an ON period of a source signal for the G color to suppress a decrease in luminance of the G color and color mixing. That is, as illustrated in the enlarged areas A and B of FIG. 10, in a transition from R to G, an R source signal (dotted line) is controlled to be turned OFF before the occurrence of a falling transition of the S-MUX for the R color, and, thus, color mixing with the G signal can be suppressed. Meanwhile, it should be understood that although not illustrated in the drawing, a transition control method configured as described below is also included in the present specification.

A transition control method according to the present exemplary embodiment is performed by a display device including a first color sub-pixel, a second color sub-pixel, and a third color sub-pixel and a transition control unit configured to control a transition for each color. The transition control method includes repeatedly performing a first step in which a kth horizontal period is time-divided into three sub-horizontal periods, and then, a first color sub-pixel is driven during a first sub-horizontal period, a second color sub-pixel is driven during a second sub-horizontal period, and a third color sub-pixel is driven during a third sub-horizontal period and a second step in which a subsequent k+1th horizontal period is time-divided into three sub-horizontal periods, and then, the third color sub-pixel is driven during a first sub-horizontal period, the first color sub-pixel is driven during a second sub-horizontal period, and the second color sub-pixel is driven during a third sub-horizontal period.

As described above, in the display device according to the present example embodiment, the number of transitions can be reduced as compared with the related art transition method, and the numbers of sub-pixel transitions for respective colors are equalized to each other. Thus, it is possible to suppress defective display caused by a sub-pixel transition.

More specifically, according to the present exemplary embodiment, when a sub-pixel transition is performed to a first color, a second color, and a third color in sequence during a kth horizontal period, the sub-pixel transition is performed to the third color, the first color, and the second color in sequence during a k+1th horizontal period. Thus, the overall number of transitions can be reduced and the numbers of sub-pixel transitions for the respective colors can be equal to each other. Therefore, it is possible to maintain excellent image output characteristics.

Also, an ON-pulse width of an S-MUX controlling a G color sub-pixel is controlled to be greater than an ON-pulse width for controlling R and B color sub-pixels. Thus, in an inversion-type display device, a decrease in luminance caused by a relatively short holding time of a G color can be suppressed.

As described herein with reference to example embodiments of the present invention, a number of transitions between sub-pixels is reduced. Thus, it is possible to simplify control for transition and reduce power consumption for transition and also possible to reduce defects in display quality caused by a sub-pixel transition. Also, the numbers of sub-pixel transitions for respective colors are equalized to each other. Thus, it is possible to suppress defective display caused by a sub-pixel transition.

Moreover, according to example embodiments, when a sub-pixel transition is performed to a first color, a second color, and a third color in sequence during a kth horizontal period, a sub-pixel transition is performed to the third color, the first color, and the second color in sequence during a k+1th horizontal period. Thus, the overall number of transitions can be reduced and the numbers of sub-pixel transitions for the respective colors can be equal to each other.

Further, according to example embodiments, in a display device including a source multiplexer (S-MUX) for switching the application of a source signal to an ith sub-pixel that displays an ith color (i=1, 2, 3), when a sub-pixel transition is performed to a first color, a second color, and a third color in sequence during a kth horizontal period, the S-MUX is controlled to perform a sub-pixel transition to the third color, the first color, and the second color in sequence during a k+1th horizontal period. Thus, the numbers of sub-pixel transitions for the respective colors are equalized to each other. Therefore, defective display caused by a sub-pixel transition can be reduced.

It will be apparent to those skilled in the art that various modifications and variations can be made in the display device and the method of sub-pixel transition of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel including gate lines, data lines, a first color sub-pixel, a second color sub-pixel, and a third color sub-pixel, wherein the first color sub-pixel, the second color sub-pixel, and the third color sub-pixel are defined by intersections between the data lines and gate lines;

a data driver configured to apply a source signal to the data lines;

a transition control unit configured to control a sequential supplying of the source signal to the first color sub-pixel, the second color sub-pixel, and the third color sub-pixel during a kth horizontal period and a sequential supplying of the source signal to the third color sub-pixel, the first color sub-pixel, and the second color sub-pixel during a k+1th horizontal period, and a source multiplexer configured to switch a supply of the source signal to each of the data lines, wherein the transition control unit is configured to control the source multiplexer, wherein the first color is red, the second color is green, and the third color is blue, and wherein the transition control unit control an ON pulse width of the source multiplexer to control the green sub-pixel to be greater than ON pulse widths of the red and blue sub-pixels.

2. The display device according to claim 1, wherein the display panel further includes a fourth color sub-pixel, wherein the transition control unit is configured control to a sequential supplying of the source signal to the first color sub-pixel, the second color sub-pixel, the third color sub-pixel, and the fourth color sub-pixel during the kth horizontal period and a sequential supplying of the source signal to the fourth color sub-pixel, the first color sub-pixel, the second color sub-pixel, and the third color sub-pixel during the k+1th horizontal period.

3. A display device, comprising;

a display panel including gate lines, data lines, a first color sub-pixel, a second color sub-pixel, and a third color sub-pixel, wherein the first color sub-pixel, the second color sub-pixel, and the third color sub-pixel are defined by intersections between the data lines and gate lines:

a data driver configured to apply a source signal to the data lines;

a transition control unit configured to control a sequential supplying of the source signal to the first color sub-pixel, the second color sub-pixel, and the third color sub-pixel during a kth horizontal period and a sequential supplying of the source signal to the third color sub-pixel, the first color sub-pixel, and the second color sub-pixel during a k+1th horizontal period; and a source multiplexer configured to switch a supply of the source signal to each of the data lines;

wherein the transition control unit is configured to control the source multiplexer, and wherein the transition control unit is configured to control ON pulses of the source multiplexer for two colors in transition to be partially overlapped.

4. The display device according to claim 3, wherein the transition control unit is configured to control ON periods of source signals for the two colors in transition not to be overlapped with each other with respect to time.

5. A method of a sub-pixel transition in a display device including a first color sub-pixel, a second color sub-pixel, and a third color sub-pixel, and a transition control unit configured to control transitions for the first, second, and third sub-pixels, the method comprising:

time-dividing a kth horizontal period into three sub-horizontal periods, and driving the first color sub-pixel during a first sub-horizontal period, the second color sub-pixel during a second sub-horizontal period, and the third color sub-pixel during a third sub-horizontal period; and time dividing a k+1th horizontal period into three sub-horizontal periods, and driving third sub-pixel during a first sub-horizontal period, the first color sub-pixel during a second sub-horizontal period, and the second color sub-pixel during a third sub-horizontal period, wherein the display device further includes a source multiplexer configured to switch the supply of a source signal to each of data lines, and the transition control unit controls the source multiplexer in the first step and the second step, wherein the first color sub-pixel is a red sub-pixel, the second color sub-pixel is a green sub-pixel, and the third color sub-pixel is a blue sub-pixel, and wherein the transition control unit controls an ON pulse width of the source multiplexer to control the green sub-pixel to be greater than ON pulse widths of the red and blue sub-pixels.

6. A method of a sub-pixel transition in a display device including a first color sub-pixel, a second color sub-pixel, and a third color sub-pixel, and a transition control unit configured to control transitions for the first, second, and third sub-pixels, the method comprising;

time-dividing a kth horizontal period into three sub-horizontal periods, and driving the first color sub-pixel during a first sub-horizontal period, the second color sub-pixel during a second sub-horizontal period, and the third color sub-pixel during a third sub-horizontal period; and time diving a k+1th horizontal period into three sub-horizontal period, and driving third sub-pixel during a first sub-horizontal period, the first color sub-pixel during a second sub-horizontal period, and the second color sub-pixel during a third sub-horizontal period, wherein the display device further includes a source multiplexer configured to switch the supply of a source signal to each of data lines, and the transition control unit controls the source multiplexer in the first step and the second step, and wherein the transition control unit is configured to control ON pulses of the source multiplexer for two colors in transition to be partially overlapped.

7. The method of a sub-pixel transition according to claim 6, wherein the transition control unit is configured to control ON periods of source signals for the two colors in transition not to be overlapped with each other with respect to time.

8. A display device, comprising:

a display panel including gate lines, data lines, a first color sub-pixel, a second color sub-pixel, and a third color sub-pixel, wherein the first color sub-pixel, the second color sub-pixel, and the third color sub-pixel are defined by intersections between the data lines and gate lines;

a data driver configured to apply a source signal to the data lines;

a source multiplexer configured to switch a supply of the source signal to each of the data lines; and a transition control unit configured to control a sub-pixel transition to be performed by supplying an ON pulse to the source multiplexer to switch the supply of the source signal to one sub-pixel among the first, second, and third sub-pixels during a first sub-horizontal period of a kth horizontal period, a second sub-horizontal period of a k+1th horizontal period, and a third sub-horizontal period of a k+2th horizontal period;

wherein the first, second, and third sub-pixels include red, green, and blue sub-pixels, and wherein the transition control unit controls an ON pulse width of the source multiplexer to control the green sub-pixel to be greater than ON pulse widths of the red and blue sub-pixels.

9. The display device according to claim 8, wherein the display panel further includes a white sub-pixel, and wherein the transition control unit is configured to drive the source multiplexer to switch the supply of the source signal to the white, red, green, and blue sub-pixels such that one sub-pixel among the white, red, green, and blue sub-pixels is turned ON during the first sub-horizontal period of the kth horizontal period, the second sub-horizontal period of the k+1th horizontal period, the third sub-horizontal period of the k+2th horizontal period, and a fourth sub-horizontal period of a k+3th horizontal period and the other ones of the sub-pixel are turned OFF in the respective sub-horizontal periods.

10. A display device comprising:

a display panel including gate lines, data lines, a first color sub-pixel, a second color sub-pixel, and a third color sub-pixel, wherein the first color sub-pixel the second color sub-pixel, and the third color sub-pixel are defined by intersections between the data lines and gate lines;

a data driver configured to apply a signal to data lines;

a source multiplexer configured to switch a supply of the source signal to each of the data lines; and a transition control runt configured to control a sub-pixel transition to be performed by supplying an ON pulse to the source multiplexer to switch the supply of the source signal to one sub-pixel among the first, second, and third sub-pixels during a first sub-horizontal period of a kth horizontal period, a second sub-horizontal period of a k+1th horizontal period, and a third sub-horizontal period of a k+2th horizontal period, wherein the first, second, and third sub-pixels include red, green, and blue sub-pixels, wherein the transition control unit controls an ON pulse width of the source multiplexer to control the green sub-pixel to be greater than ON pulse widths of the red and blue sub-pixels, and wherein the transition control unit is configured to control ON pulses of the source multiplexer for two colors in transition to be partially overlapped.

* * * * *